US010968712B1

(12) United States Patent
He et al.

(10) Patent No.: US 10,968,712 B1
(45) Date of Patent: Apr. 6, 2021

(54) ADAPTABLE ANCHOR, SYSTEM AND METHOD

(71) Applicants: Zhi Yong He, Cypress, TX (US); Yuh Loh, Cypress, TX (US); Jason Harper, Cypress, TX (US)

(72) Inventors: Zhi Yong He, Cypress, TX (US); Yuh Loh, Cypress, TX (US); Jason Harper, Cypress, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/664,180

(22) Filed: Oct. 25, 2019

(51) Int. Cl.
*E21B 23/01* (2006.01)

(52) U.S. Cl.
CPC ..... *E21B 23/01* (2013.01)

(58) Field of Classification Search
CPC ..... E21B 23/01
USPC ..... 166/382
See application file for complete search history.

(56) References Cited

U.S. PATENT DOCUMENTS 3,664,416 A * 5/1972 Nicolas ..... G01V 11/005 166/66.4
4,971,146 A * 11/1990 Terrell ..... E21B 17/1021 166/212
6,920,936 B2 7/2005 Sheiretov et al.
8,127,856 B1 * 3/2012 Nish ..... E21B 33/1294 166/376
8,286,716 B2 * 10/2012 Martinez ..... E21B 23/01 166/382
9,482,067 B2 * 11/2016 Dewars ..... E21B 33/00
9,488,020 B2 * 11/2016 Krueger, V ..... E21B 23/04
10,450,840 B2 10/2019 Xu
2003/0173076 A1 * 9/2003 Sheiretov ..... B66F 3/12 166/241.1
2009/0071659 A1 3/2009 Spencer et al.
(Continued)

FOREIGN PATENT DOCUMENTS

WO 2019194680 A1 10/2019

OTHER PUBLICATIONS

Notification of Transmittal of the International Search Report and the Written Opinion of the International Searching Authority, or the Declaration; PCT/US2020/055655; dated Jan. 29, 2021; 11 pages.

*Primary Examiner* — Taras P Bemko
(74) *Attorney, Agent, or Firm* — Cantor Colburn LLP

(57) ABSTRACT

An adaptable anchor includes a frame; an arm articulated to the frame; a pad connected to the arm at a distance from the articulation with the frame; a wedge movably mounted to the frame and in wedging contact with the arm; a biasing member disposed to selectively apply a biasing energy between the frame and the wedge; and a degradable retainer preventing application of the biasing energy until degraded. An embodiment of a borehole system includes a borehole in a subsurface formation; a tubular member disposed in the borehole; and an adaptable anchor as in any prior embodiment in operable contact with the tubular member. An embodiment of a method for anchoring a tool in a borehole includes running the adaptable anchor into a borehole; degrading the degradable retainer; urging the wedge into contact with the arm with the biasing member; and displacing the pad.

20 Claims, 4 Drawing Sheets

(56) References Cited

U.S. PATENT DOCUMENTS

| | | | | |
|---|---|---|---|---|
| 2010/0018695 | A1* | 1/2010 | Bloom | E21B 23/10<br>166/206 |
| 2014/0083720 | A1 | 3/2014 | Kang et al. | |

* cited by examiner

ADAPTABLE ANCHOR, SYSTEM AND METHOD

BACKGROUND

In the resource recovery industry, it is often necessary to anchor tools and tubing strings in a borehole in a subsurface formation to enable the tool to perform its intended function or to locate and support a tubing string, for example. To this end, many tools are manufactured with anchors as a part of the tool. Most of these are set using fluid pressure. Fluid pressure setting regimes requires seals and sometimes fluid conveyances such as capillary lines and the like. These can increase expense for an operation and in some situations due to volume of hydraulic fluid for various particular tools, take up valuable surface space.

The art would well receive a more adaptable anchoring system that avoids drawbacks of the prior art.

SUMMARY

An adaptable anchor including a frame; an arm articulated to the frame; a pad connected to the arm at a distance from the articulation with the frame; a wedge movably mounted to the frame and in wedging contact with the arm; a biasing member disposed to selectively apply a biasing energy between the frame and the wedge; and a degradable retainer preventing application of the biasing energy until degraded.

A borehole system including a borehole in a subsurface formation; a tubular member disposed in the borehole; and an adaptable anchor including a frame; an arm articulated to the frame; a pad connected to the arm at a distance from the articulation with the frame; a wedge movably mounted to the frame and in wedging contact with the arm; a biasing member disposed to selectively apply a biasing energy between the frame and the wedge; and a degradable retainer preventing application of the biasing energy until degraded in operable contact with the tubular member.

An embodiment of a method for anchoring a tool in a borehole including running the adaptable anchor including a frame; an arm articulated to the frame; a pad connected to the arm at a distance from the articulation with the frame; a wedge movably mounted to the frame and in wedging contact with the arm; a biasing member disposed to selectively apply a biasing energy between the frame and the wedge; and a degradable retainer preventing application of the biasing energy until degraded; degrading the degradable retainer; urging the wedge into contact with the arm with the biasing member; and displacing the pad.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
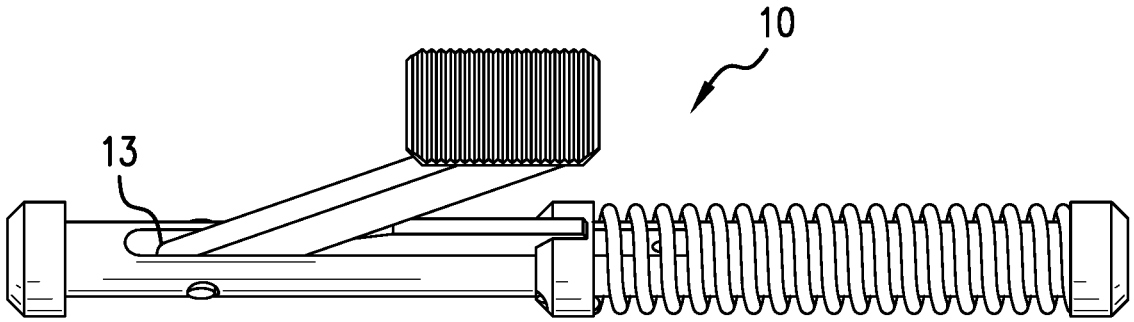
FIG. 1 is a perspective view of an adaptable anchor as disclosed herein.

Referring to FIG. 1, an adaptable anchor 10 is illustrated in perspective view. It is to be understood that the anchor 10 is contemplated for use in a borehole environment such as a resource recovery borehole in a subsurface formation. The anchor is functional in open or cased boreholes and also in other tubular members either in or out of the borehole. When actuated, the adaptable anchor will hold its position in the borehole or tubular member. The adaptable anchor 10 is simple, relatively small and lightweight by resource recovery standards and reliable. The adaptable anchor 10 also facilitates modularity thereby making anchors available for a wide range of tools without specific engineering and a large inventory.

Figure 2:
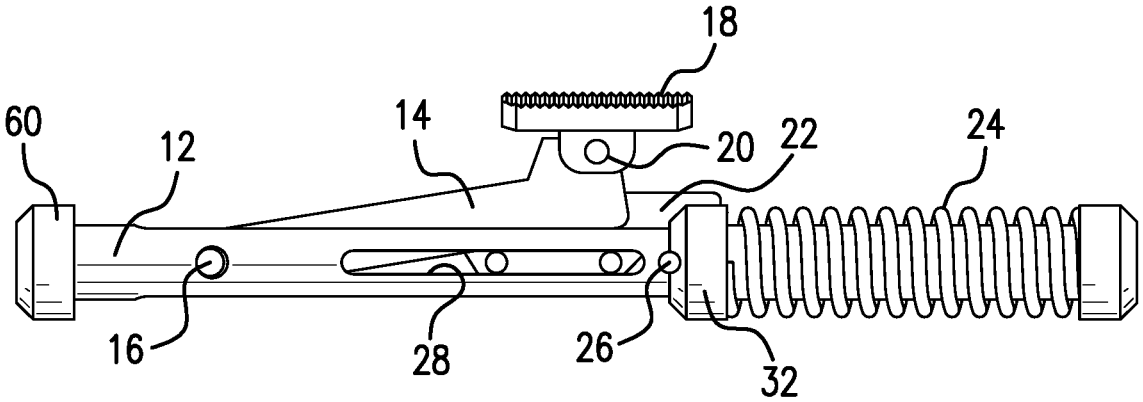
FIG. 2 is a side view of the anchor as illustrated in FIG. 1 in a run-in position.
Figure 3:
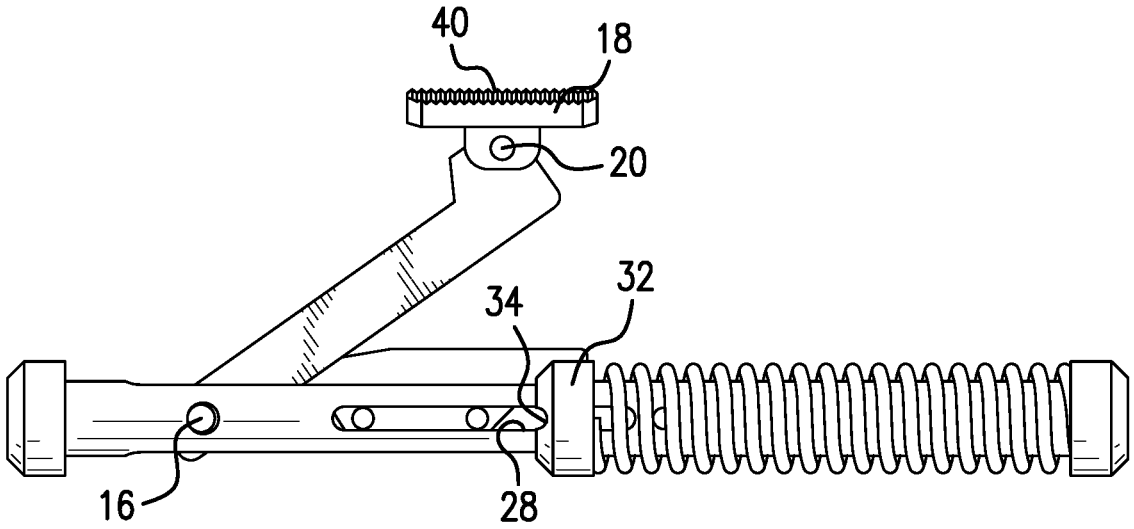
FIG. 3 is a side view of the anchor as illustrated in FIG. 1 in a deployed position.

Referring to FIG. 2, a side view of the adaptable anchor 10 is addressed to identify the components of the anchor 10. A frame 12 supports an arm 14 through an articulation 16 that allows the arm 14 to rotate about the articulation 16 in a void 13 within the frame 12 (most easily appreciated in FIG. 1). The articulation may comprise a pin in an embodiment. Mounted to the arm 14 is a pad 18 that is configured to engage a structure such as a borehole wall (open hole or cased) or other tubular member to secure the anchor 10 in place. The pad 18, in an embodiment is articulated to the arm at a pad articulation 20, which may be a pin or may be a universal joint in various iterations, for example. Interactive with the arm 14 is a wedge 22. The wedge 22 is movable along the frame 12 from a run-in position shown in FIG. 2 to a deployed position shown in FIG. 3. One will also note that when the wedge has assumed the position of FIG. 3, the arm 14 is rotated outwardly from the frame 12 into a deployed anchored position. Moving the wedge 22 from the run-in position to the deployed position is a biasing member 24 that is maintained in a compressed state by a retainer 26, such as for example a pin, during run-in and until the retainer 26 is no longer an impediment to extension of the biasing member 24. The retainer 26 is no longer an impediment to extension of the member 24 when the retainer 26 is degraded to a state that the member 24 will overpower the retainer 26. At this point, the stored energy of the biasing member is released to urge the wedge 22 toward the arm 14 causing the rotation of the arm 14. The degradation of the retainer 26 may be by time exposed to natural wellbore fluids, by applied fluids, by degrade on demand inputs (see U.S. Pat. No. 10,450,840 incorporated herein by reference in its entirety), etc.

Because the actuation of the adaptable anchor is by degradation of retainer 26, hydraulic methods so commonly used in the industry for actuating anchors, with all of the attendant issues surrounding the use of fluid pressure for the actuation, are avoided. This makes for a simpler construction and simpler actuation thereby saving time and money.

Figure 4:
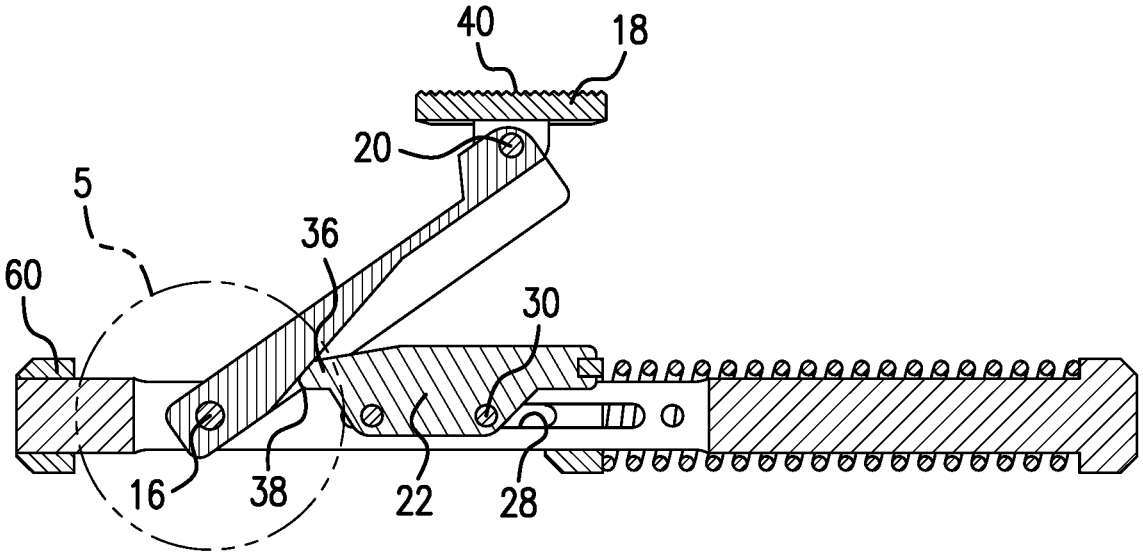
FIG. 4 is a cross section view of the anchor as illustrated in FIG. 3 still in the deployed position.

Referring to FIG. 4, some additional components and operation is addressed. In FIG. 4, which is a section view of FIG. 3, it is plain to see how movement of the wedge 22 is controlled by the frame 12. Frame 12 includes a slot 28 that is receptive to a guide 30 (or more as shown). A longer guide 30 (in the direction of a longitudinal axis of the frame 12) could also be substituted, if desired. Due to the slot 28, the wedge 22 moves linearly along the frame 12. The wedge 22 is in contact with a cap 32 that is disposed in biased contact with the biasing member 24. The cap 32 in embodiments also includes a groove 34 within which retainer 26 may reside prior to degradation. It should be understood that when the retainer 26 can no longer contain the energy stored in the biasing member 24 in the run-in position, that the cap 32 will move toward the arm 14 pushing the wedge 22 ahead of it. The wedge urges a nose 36 against a cam face 38 of the arm 14. This action causes a rotational moment in the arm 14 about the articulation 16 and hence makes pad 18 deploy against a wall of the tubular (see FIG. 6) or borehole opposite where the frame 12 will seat, thereby anchoring the adaptable anchor 10 in place. In embodiments, the pad 18 may include a surface configured to enhance gripping force 40 that in an iteration may be wickers.

Figure 5:
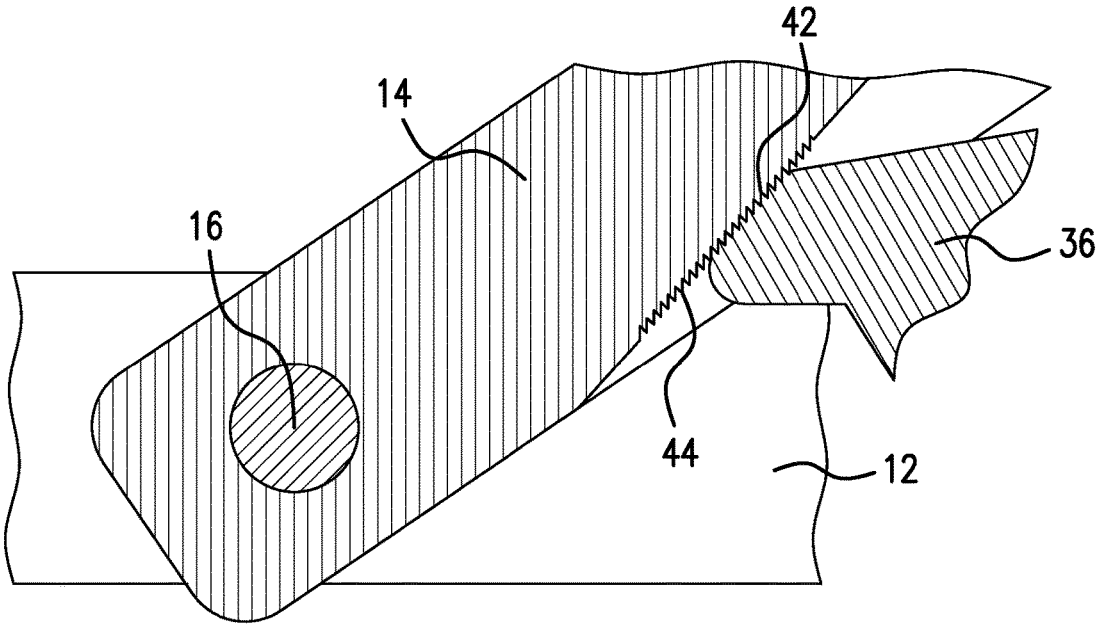
FIG. 5 is an enlarged view of circumscribed area 5-5 in FIG. 4.

In embodiments, the nose 36 and/or the cam face 38 may be provided with teeth 42 and 44 respectively (see FIG. 5) to ensure one-way movement is promoted and reverse movement is inhibited. This will tend to ensure the adaptable anchor 10, once anchored, will stay that way.

Figure 6:
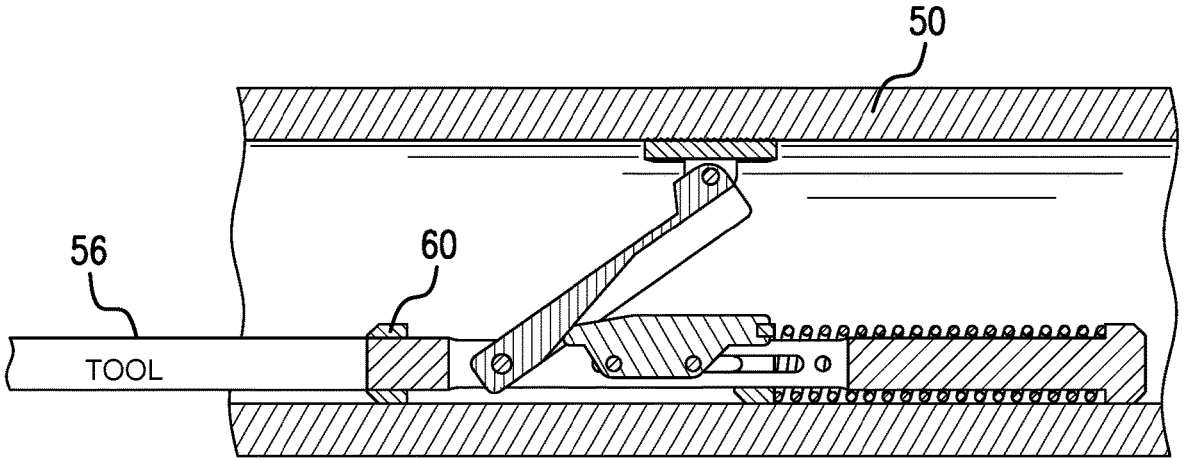
FIG. 6 is a view of the anchor as illustrated in FIG. 4 positioned within a tubular to which the anchor is shown anchored.
Figure 7:
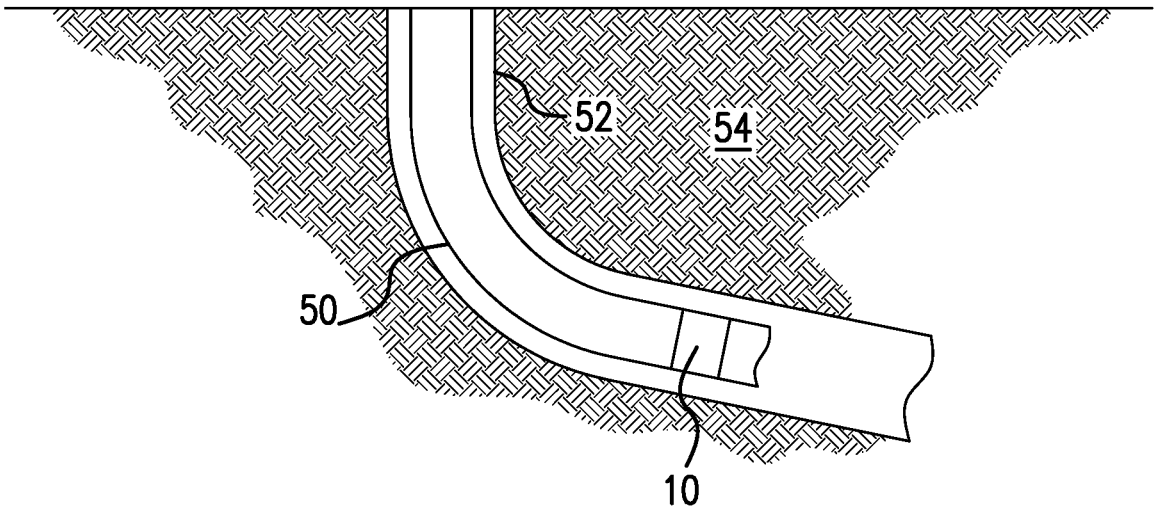
FIG. 7 is a schematic view of a borehole system which the adaptable anchor as described herein is deployed.

Referring to FIGS. 6 and 7, a borehole system can be appreciated that employs the adaptable anchor 10. The system includes a tubular 50 disposed in a borehole 52 in a subsurface formation 54. While FIG. 6 illustrates the adaptable anchor 10 set within the tubular 50, it is also contemplated that the tubular 50 be the conveying device for the adaptable anchor 10 and that anchor 10 be set in another tubular radially outwardly of the tubular 50 or in open hole. Also notable in FIG. 6 is a portion denoted "tool" and given the numeral 56. This may be any type of tool that requires an anchor downhole. It is contemplated that the adaptable anchor 10 includes an interengagement feature 60 in order to attach the anchor 10 to a target tool. The particular configuration of the interengagement feature 60 may be as is needed and includes threads, press fits, collets connections, J-slot type connections, welded connections, etc. It is intended that the adaptable anchor 10 be fittable to a wide variety of tools that all use the same interengagement feature.

Set forth below are some embodiments of the foregoing disclosure:

Embodiment 1: An adaptable anchor including a frame; an arm articulated to the frame; a pad connected to the arm at a distance from the articulation with the frame; a wedge movably mounted to the frame and in wedging contact with the arm; a biasing member disposed to selectively apply a biasing energy between the frame and the wedge; and a degradable retainer preventing application of the biasing energy until degraded.

Embodiment 2: The adaptable anchor as in any prior embodiment wherein the arm is articulated to the frame at one end of the arm and the wedge is disposed at an opposite end of the arm.

Embodiment 3: The adaptable anchor as in any prior embodiment wherein the pad is articulated to the arm.

Embodiment 4: The adaptable anchor as in any prior embodiment wherein the pad further includes a surface configured to enhance gripping force.

Embodiment 5: The adaptable anchor as in any prior embodiment wherein the surface includes wickers.

Embodiment 6: The adaptable anchor as in any prior embodiment wherein the wedge includes teeth thereon interactive with the arm.

Embodiment 7: The adaptable anchor as in any prior embodiment wherein the arm includes teeth interactive with the wedge.

Embodiment 8: The adaptable anchor as in any prior embodiment wherein the wedge further includes guide.

Embodiment 9: The adaptable anchor as in any prior embodiment wherein the guide is a pin interactive with a slot in the frame.

Embodiment 10: The adaptable anchor as in any prior embodiment wherein the biasing member is a spring.

Embodiment 11: The adaptable anchor as in any prior embodiment further including an interengagement feature configured to interengage the adaptable anchor with another tool.

Embodiment 12: The adaptable anchor as in any prior embodiment further including a biasing member cap configured to contact the wedge.

Embodiment 13: The adaptable anchor as in any prior embodiment wherein the degradable retainer is degradable in the presence of downhole fluids.

Embodiment 14: The adaptable anchor as in any prior embodiment wherein the degradable retainer is a degrade on demand retainer.

Embodiment 15: A borehole system including a borehole in a subsurface formation; a tubular member disposed in the borehole; and an adaptable anchor as in any prior embodiment in operable contact with the tubular member.

Embodiment 16: The borehole system as in any prior embodiment wherein the adaptable anchor is run in the hole by the tubular member.

Embodiment 17: The borehole system as in any prior embodiment wherein the adaptable anchor is run inside the tubular member and is configured to anchor therein.

Embodiment 18: A method for anchoring a tool in a borehole including running the adaptable anchor as in any prior embodiment; degrading the degradable retainer; urging the wedge into contact with the arm with the biasing member; and displacing the pad.

Embodiment 19: The method as in any prior embodiment wherein the displacing is driving the pad into contact with another structure to anchor the adaptable anchor to that structure.

Embodiment 20: The method as in any prior embodiment wherein the degrading is by allowing time or by taking an action that will degrade the retainer.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An adaptable anchor comprising:

a frame;

an arm directly connected to the frame and articulated therefrom;

a pad connected to the arm at a distance from the articulation with the frame;

a wedge mounted directly to the frame and movable along the frame and in wedging contact with the arm;

a biasing member disposed to selectively apply a biasing energy between the frame and the wedge; and a degradable retainer preventing application of the biasing energy until degraded.

2. The adaptable anchor as claimed in claim 1 wherein the arm is articulated to the frame at one end of the arm and the wedge is disposed at an opposite end of the arm.

3. The adaptable anchor as claimed in claim 1 wherein the pad is articulated to the arm.

4. The adaptable anchor as claimed in claim 1 wherein the pad further includes a surface configured to enhance gripping force.

5. The adaptable anchor as claimed in claim 4 wherein the surface includes wickers.

6. The adaptable anchor as claimed in claim 1 wherein the wedge includes teeth thereon interactive with the arm.

7. The adaptable anchor as claimed in claim 1 wherein the arm includes teeth interactive with the wedge.

8. The adaptable anchor as claimed in claim 1 wherein the wedge further includes a guide.

9. The adaptable anchor as claimed in claim 8 wherein the guide is a pin interactive with a slot in the frame.

10. The adaptable anchor as claimed in claim 1 wherein the biasing member is a spring.

11. The adaptable anchor as claimed in claim 1 further including an interengagement feature configured to interengage the adaptable anchor with another tool.

12. The adaptable anchor as claimed in claim 1 further including a biasing member cap configured to contact the wedge.

13. The adaptable anchor as claimed in claim 1 wherein the degradable retainer is degradable in the presence of downhole fluids.

14. The adaptable anchor as claimed in claim 1 wherein the degradable retainer is a degrade on demand retainer.

15. A borehole system comprising:

a borehole in a subsurface formation;

a tubular member disposed in the borehole; and an adaptable anchor as claimed in claim 1 in operable contact with the tubular member.

16. The borehole system as claimed in claim 15 wherein the adaptable anchor is run in the hole by the tubular member.

17. The borehole system as claimed in claim 15 wherein the adaptable anchor is run inside the tubular member and is configured to anchor therein.

18. A method for anchoring a tool in a borehole comprising:

running the adaptable anchor as claimed in claim 1;

degrading the degradable retainer;

urging the wedge into contact with the arm with the biasing member; and displacing the pad.

19. The method as claimed in claim 18 wherein the displacing is driving the pad into contact with another structure to anchor the adaptable anchor to that structure.

20. The method as claimed in claim 18 wherein the degrading is by allowing time or by taking an action that will degrade the retainer.

* * * * *